US010273761B2

(12) United States Patent
SadAbadi et al.

(10) Patent No.: US 10,273,761 B2
(45) Date of Patent: Apr. 30, 2019

(54) AXIAL RETENTION CONNECTION FOR A DOWNHOLE TOOL

(71) Applicant: Halliburton Energy Services, Inc., Houston, TX (US)

(72) Inventors: Hamid SadAbadi, Edmonton (CA); Neil Roy Choudhury, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/527,172

(22) PCT Filed: Dec. 17, 2014

(86) PCT No.: PCT/US2014/070861
§ 371 (c)(1),
(2) Date: May 16, 2017

(87) PCT Pub. No.: WO2016/099487
PCT Pub. Date: Jun. 23, 2016

(65) Prior Publication Data

US 2017/0335636 A1 Nov. 23, 2017

(51) Int. Cl.
*E21B 17/04* (2006.01)

(52) U.S. Cl.
CPC ..... *E21B 17/04* (2013.01)

(58) Field of Classification Search
CPC ..... E21B 23/04; E21B 17/076; E21B 17/04
See application file for complete search history.

(56) References Cited

U.S. PATENT DOCUMENTS 3,561,473 A * 2/1971 Chenoweth ..... E21B 34/08 137/542
3,664,184 A 5/1972 Dyer
3,860,272 A 1/1975 Becker
(Continued)

FOREIGN PATENT DOCUMENTS

CA 2510632 C 6/2004
CN 201896592 7/2011
(Continued)

OTHER PUBLICATIONS

Longyear, Boart "Hard Rock Performance Tooling." Hexagonal Coupler, retrieved from http://www.boardongyear.com/performance-tooling/hand-rock-performance-tooling/, 2014; 3 pgs, Sep. 23, 2014.
(Continued)

*Primary Examiner* — Giovanna C. Wright
*Assistant Examiner* — Yanick A Akaragwe
(74) *Attorney, Agent, or Firm* — Baker Botts L.L.P.

(57) ABSTRACT

A axial retention connection for a downhole tool is disclosed. The connection includes a drill string component including a socket having a plurality of walls and a top surface. The connection additionally includes a downhole tool coupled to the socket, the downhole tool including a male-type connector having an outer perimeter and a top surface. The connection further includes a seal between the drill string component and the downhole tool. The connection further includes a chamber formed by the plurality of walls and the top surface of the socket and the top surface of the male-type connector; and a fluid filling the chamber.

20 Claims, 5 Drawing Sheets

(56) References Cited

U.S. PATENT DOCUMENTS

| | | | | |
|---|---|---|---|---|
| 4,073,352 | A | 2/1978 | Underwood | |
| 4,963,078 | A | 10/1990 | Agee | |
| 4,982,801 | A | 1/1991 | Zitka et al. | |
| 5,240,077 | A * | 8/1993 | Whitsitt | E21B 33/1295 166/120 |
| 5,720,355 | A | 2/1998 | Lamine et al. | |
| 5,927,411 | A | 7/1999 | Sheirer | |
| 6,182,774 | B1 | 2/2001 | Tibbits | |
| 6,305,723 | B1 | 10/2001 | Schutz et al. | |
| 6,520,271 | B1 | 2/2003 | Martini | |
| 6,949,025 | B1 | 9/2005 | Kraus et al. | |
| 7,216,724 | B2 | 5/2007 | Self et al. | |
| 7,845,432 | B2 | 12/2010 | Salins et al. | |
| 7,900,720 | B2 | 3/2011 | Hall et al. | |
| 8,381,840 | B2 * | 2/2013 | Nielsen | E21B 19/16 166/77.51 |
| 8,485,798 | B2 | 7/2013 | Sheth et al. | |
| 2008/0236835 | A1 * | 10/2008 | Rayssiguier | E21B 17/076 166/332.1 |
| 2009/0152011 | A1 | 6/2009 | Hall et al. | |
| 2010/0044113 | A1 | 2/2010 | LeBlanc et al. | |
| 2012/0067924 | A1 * | 3/2012 | Deans | B05B 11/0048 222/256 |
| 2013/0312965 | A1 * | 11/2013 | Themig | E21B 34/063 166/285 |
| 2014/0027184 | A1 | 1/2014 | Slaughter et al. | |
| 2014/0196886 | A1 | 7/2014 | Morrow | |

FOREIGN PATENT DOCUMENTS

| | | |
|---|---|---|
| EP | 1108496 | 6/2001 |
| WO | 2016/099487 | 6/2016 |

OTHER PUBLICATIONS

International Search Report and Written Opinion from PCT Patent Application No. PCT/US2014/070861, dated Aug. 21, 2015; 11 pgs.

Extended European Search Report for European Patent Application No. 14908577.1, dated May 3, 2018; 8 pages.

* cited by examiner

AXIAL RETENTION CONNECTION FOR A DOWNHOLE TOOL

RELATED APPLICATIONS

This application is a U.S. National Stage Application of International Application No. PCT/US2014/070861 filed Dec. 17, 2014, which designates the United States, and which is incorporated herein by reference in its entirety.

TECHNICAL FIELD

The present disclosure relates generally to downhole tools and, more particularly, to an axial retention connection for a downhole tool.

BACKGROUND

Hydrocarbons, such as oil and gas, are commonly obtained from subterranean formations that may be located onshore or offshore. The development of subterranean operations and the processes involved in removing natural resources from a subterranean formation are complex. Typically, subterranean operations involve a number of different steps such as, for example, drilling a borehole at a desired well site, treating the borehole to optimize production of the natural resources, and performing the necessary steps to produce and process the natural resources from the subterranean formation.

Downhole tools are used within a wellbore to assist with the production of hydrocarbons from a subterranean formation. Some common downhole tools are drill bits, coring bits, drill collars, rotary steering tools, downhole drilling motors, reamers, hole enlargers, and stabilizers. During subterranean operations, the downhole tools may be coupled to a drill string and lowered into the wellbore.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

During a subterranean operation, various downhole tools (e.g., drill bits, coring bits, drill collars, rotary steering tools, downhole drilling motors, reamers, hole enlargers, and/or stabilizers) may be lowered in a wellbore. The downhole tool may be coupled to a drill string via an axial retention connection that uses differential pressure to couple the downhole tool to the drill string. The axial retention connection may include a male-type connector located on the downhole tool inserted into a female-type socket on a connection point of an uphole component (e.g., a component on the drill string). A chamber may be formed between the male-type connector and the female-type socket and may be filled with a fluid. Once the chamber is filled with fluid and the connector is fully inserted into the socket, the chamber may be sealed and the pressure of the fluid in the chamber may hydraulically couple the downhole tool to the drill string. The axial retention connection may couple the downhole tool to the drill string using less axial length of the drilling components and/or the downhole tool than conventional coupling methods. Additionally, the axial retention connection may allow for a longer drive train on the drill string, increase the torque carrying capacity of the downhole tool, and reduce the manufacturing costs of creating a coupling mechanism between a drill string and a downhole tool. Embodiments of the present disclosure and its advantages are best understood by referring to FIGS. 1A through 4, where like numbers are used to indicate like and corresponding parts.

Figure 1A:
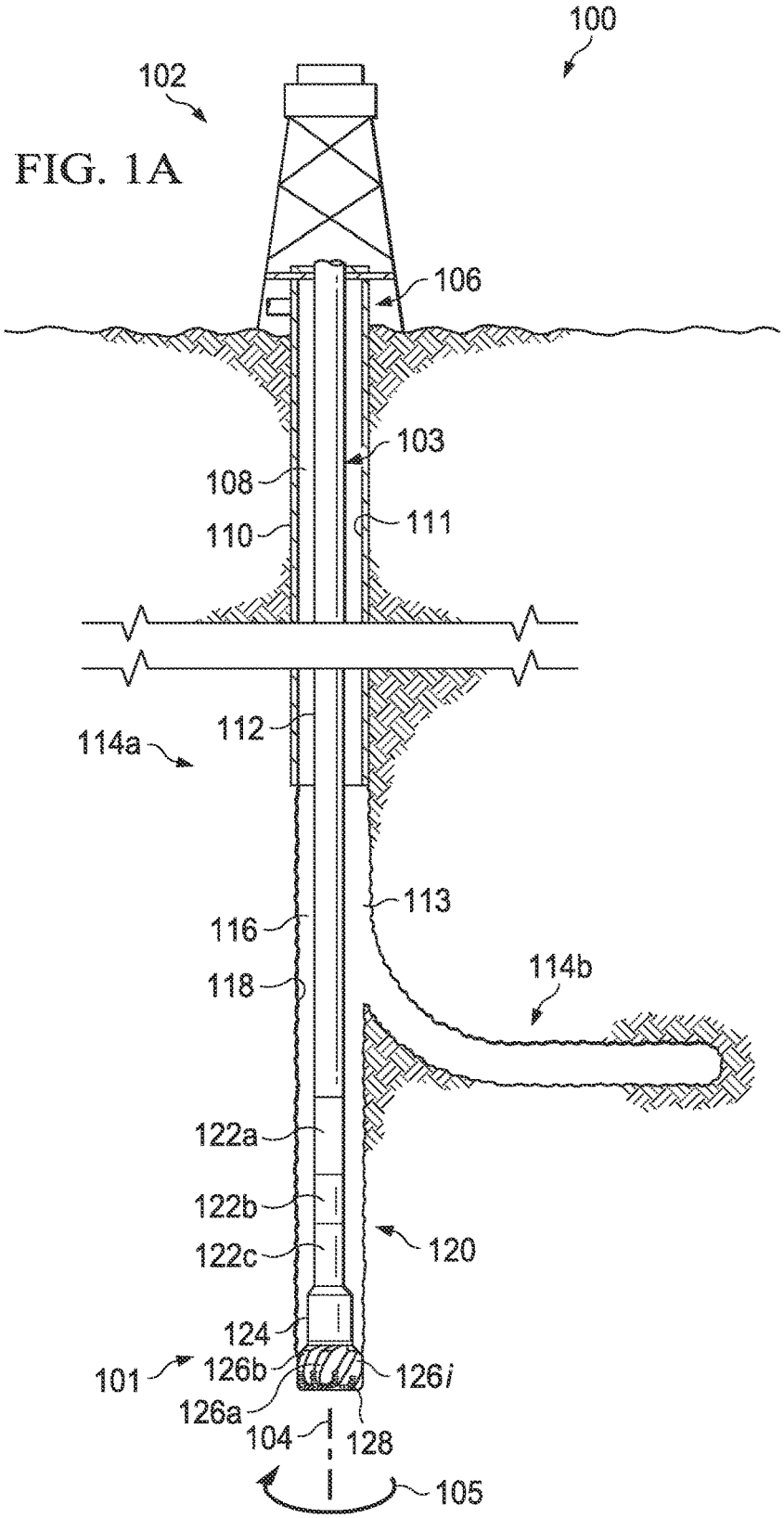
FIG. 1A is an elevation view of an example embodiment of a drilling system.

FIG. 1A is an elevation view of an example embodiment of a drilling system 100. Drilling system 100 may include a well surface or well site 106. Various types of drilling equipment such as a rotary table, drilling fluid pumps, and drilling fluid tanks (not expressly shown) may be located at well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles, and drilling barges (not expressly shown).

Drilling system 100 may also include drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term "directional drilling" may be used to describe drilling a wellbore or portions of a wellbore that extend at a desired angle or angles relative to vertical. The desired angles may be greater than normal variations associated with vertical wellbores. Direction drilling may also be described as drilling a wellbore deviated from vertical. The term "horizontal drilling" may be used to include drilling in a direction approximately ninety degrees (90°) from vertical.

BHA 120 may be formed from a wide variety of components configured to form wellbore 114. For example, components 122*a*, 122*b*, and 122*c* of BHA 120 may include, but are not limited to, drill bits (e.g., drill bit 101), coring bits, drill collars, rotary steering tools, directional drilling tools, downhole drilling motors, reamers, hole enlargers, or stabilizers. The number and types of components 122 included in BHA 120 may depend on anticipated downhole drilling conditions and the type of wellbore that will be formed by drill string 103 and rotary drill bit 101. BHA 120 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools, and/or any other commercially available well tool.

Wellbore 114 may be defined in part by casing string 110 that may extend from well site 106 to a selected downhole location. Portions of wellbore 114, as shown in FIG. 1A, that do not include casing string 110 may be described as "open hole." Various types of drilling fluid may be pumped from well surface 106 through drill string 103 to attached drill bit 101. The drilling fluids may be directed to flow from drill string 103 to respective nozzles passing through rotary drill bit 101. The drilling fluid may be circulated back to well surface 106 through annulus 108 defined in part by outside diameter 112 of drill string 103 and inside diameter 118 of wellbore 114. Inside diameter 118 may be referred to as the "sidewall" of wellbore 114. Annulus 108 may also be defined by outside diameter 112 of drill string 103 and inside diameter 111 of casing string 110. Open hole annulus 116 may be defined as sidewall 118 and outside diameter 112.

Drilling system 100 may also include rotary drill bit ("drill bit") 101. Drill bit 101 may include one or more blades 126 that may be disposed outwardly from exterior portions of rotary bit body 124 of drill bit 101. Rotary bit body 124 may be generally cylindrical and blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

Downhole tools such as the components of BHA 120 (e.g., components 122*a*, 122*b*, 122*c*, and/or drill bit 101) may be coupled to drill string 103 and/or each other via an axial retention connection. The connection may include a male-type connector on the downhole tool and a female-type connector (e.g., a socket) on a component of drill string 103 to which the downhole tool is to be attached. The socket may be located uphole of the male-type connector and the male-type connector may be inserted into the socket. A sealed chamber between the socket and the male-type connector may be filled with fluid and the hydraulic effect of the fluid in the sealed chamber may result in a coupling of the downhole tool and drill string 103. As the depth and/or the diameter of wellbore 114 increases, the size of the downhole tools connected to drill string 103 (e.g., BHA 120 and/or drill bit 101) may increase. Additionally, as the size of the downhole tool increases, the torque created by the downhole tool may also increase. As such, the axial retention connection between the downhole tool and drill string 103 (described in more detail with respect to FIG. 2) may be designed to withstand the increased torque created by the downhole tool.

During the subterranean operation, the forces acting on the downhole tool (e.g., the weight on bit (WOB)) may push the male-type connector in the uphole direction and into the socket. However, during a failure (e.g., after a failure of a driveshaft or any part of BHA 120 below the coupling between the socket and male-type connector), the forces acting on the downhole tool during the drilling operation may decrease or be eliminated and gravity may pull the downhole tool in the downhole direction. The differential pressure of the fluid in the chamber between the socket and the male-type connector may keep the socket and male-type connector coupled during the failure.

Figure 1B:
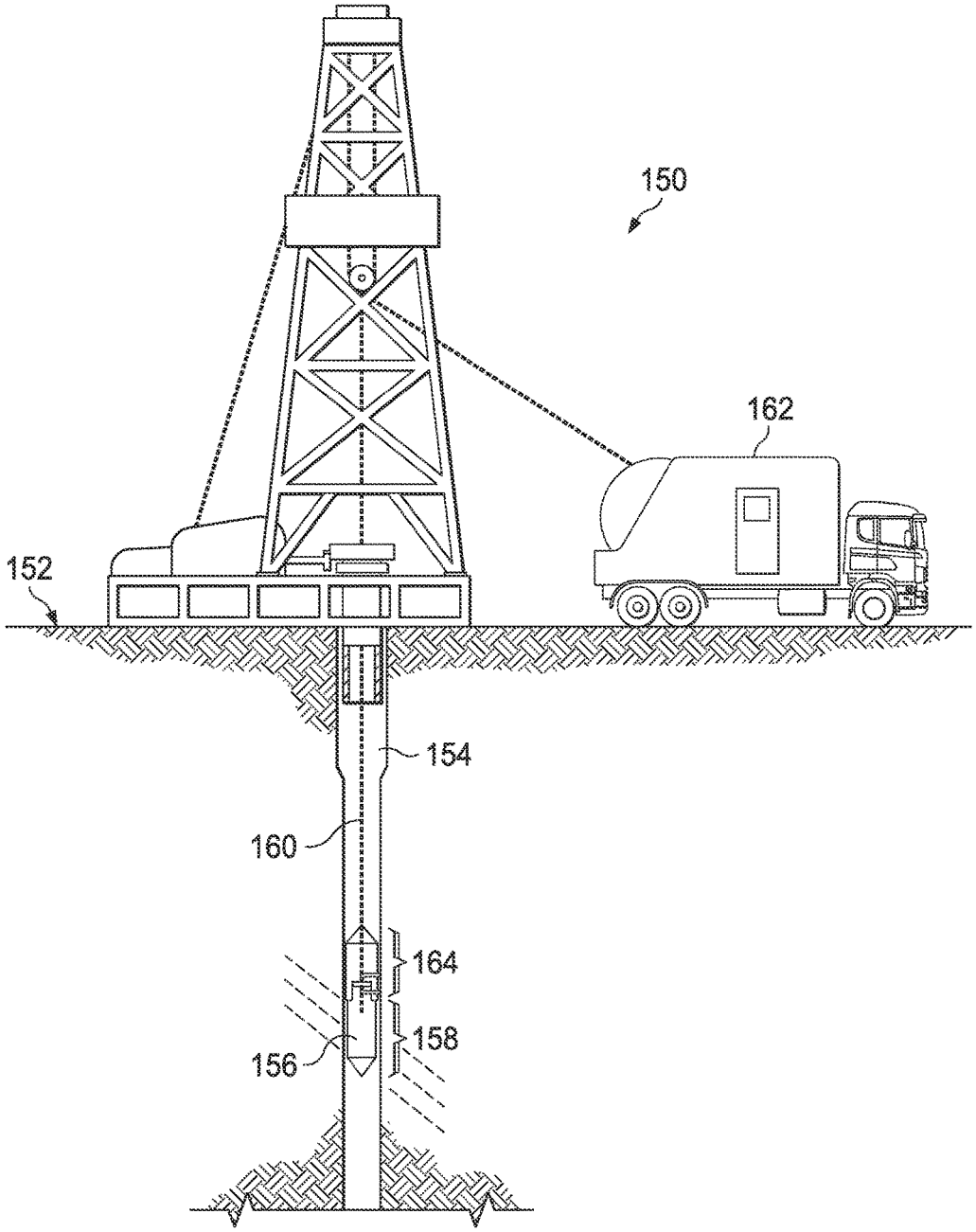
FIG. 1B illustrates an elevation view of an example embodiment of a subterranean operations system used in an illustrative wellbore environment.

FIG. 1B illustrates an elevation view of an example embodiment of a subterranean operations system used in an illustrative wellbore environment. Modern hydrocarbon drilling and production operations may use conveyances such as ropes, wires, lines, tubes, or cables (hereinafter "line") to suspend a downhole tool in a wellbore. Although FIG. 1B shows land-based equipment, downhole tools incorporating teachings of the present disclosure may be satisfactorily used with equipment located on offshore platforms, drill ships, semi-submersibles, and drilling barges (not expressly shown). Additionally, while wellbore 154 is shown as being a generally vertical wellbore, wellbore 154 may be any orientation including generally horizontal, multilateral, or directional.

Subterranean operations system 150 may include wellbore 154. "Uphole" may be used to refer to a portion of wellbore 154 that is closer to well surface 152 and "downhole" may be used to refer to a portion of wellbore 154 that is further from well surface 152. Subterranean operations may be conducted using wireline system 156 including one or more downhole tools 158 that may be suspended in wellbore 154 from line 160. Line 160 may be any type of conveyance, such as a rope, cable, line, tube, or wire which may be suspended in wellbore 154. In some embodiments, line 160 may be a single strand of conveyance. In other embodiments, line 160 may be a compound or composite line made of multiple strands of conveyance woven or braided together. Line 160 may be compound when a stronger line is required to support downhole tool 158 or when multiple strands are required to carry different types of power, signals, and/or data. As one example of a compound line, line 160 may include multiple fiber optic cables braided together and the cables may be coated with a protective coating. In another embodiment, line 160 may be a slickline. In a further embodiment, line 160 may be a hollow line or a line containing a sensitive core, such as a sensitive data transmission line.

The weight of downhole tool 158 may be transferred to line 160 at the points where the rope socket is in contact with line 160 and may exert a force on line 160. Localized forces and/or pressure exerted on line 160 may cause line 160 to be compressed or crushed at the contact point between rope socket 164 and line 160, which may cause damage to line 160. Slicklines, hollow lines, and lines containing a sensitive core may be likely to be crushed, weakened, or otherwise mechanically damaged by localized forces created when the slickline, hollow line, or line containing a sensitive core is coupled to downhole tool 158. When line 160 is damaged, the ability of line 150 to transmit signals (e.g., between logging facility 162 and downhole tool 158) may be reduced or eliminated. For example, when a fiber optic line 160 is crushed, the ability of line 160 to transmit light may be reduced and line 160 may be unable to transmit power, data, and/or signals. Additionally, damage to line 160 may cause a weak spot in line 160 that may increase the likelihood that line 160 may break during a subterranean operation.

Line 160 may include one or more conductors for transporting power, data, and/or signals to wireline system 156 and/or telemetry data from downhole tool 158 to logging facility 162. Alternatively, line 160 may lack a conductor, as is often the case using slickline or coiled tubing, and wireline system 156 may include a control unit that includes memory, one or more batteries, and/or one or more processors for performing operations to control downhole tool 158 and for storing measurements. Logging facility 162 (shown in FIG. 1B as a truck, although it may be any other structure) may collect measurements from downhole tool 158, and may include computing facilities for controlling downhole tool 158, processing the measurements gathered by downhole tool 158, or storing the measurements gathered by downhole tool 158. The computing facilities may be communicatively coupled to downhole tool 158 by way of line 160. While logging facility 162 is shown in FIG. 1B as being onsite, logging facility 162 may be located remote from well surface 152 and wellbore 154.

Figure 4:
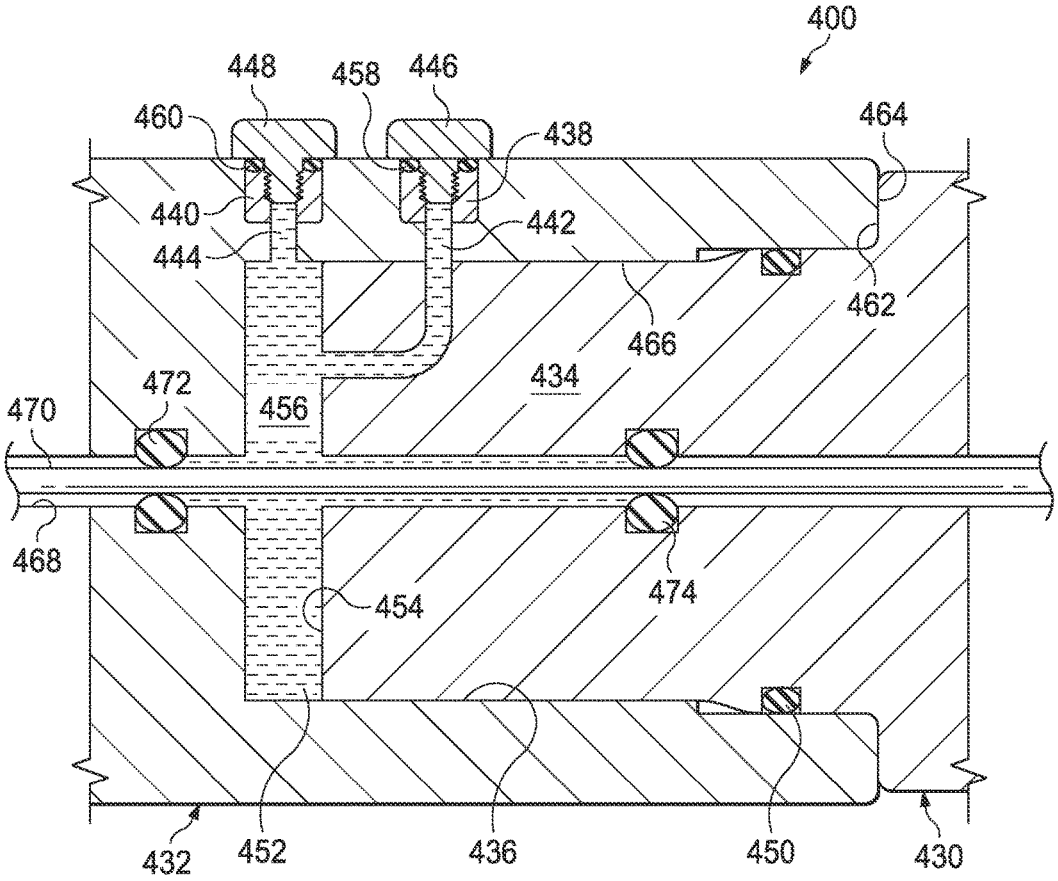
FIG. 4 illustrates a cross-sectional view of a downhole tool and a wireline component coupled via an axial retention connection.

During a wireline operation, downhole tool 158 may be coupled to component 164, as shown in more detail in FIG. 4. Downhole tool 158 may be coupled to component 164 and/or each other via an axial retention connection. The connection may include a male-type connector on the downhole tool and a female-type connector (e.g., a socket) on component 164 to which downhole tool 158 is to be attached. The socket may be located uphole of the male-type connector and the male-type connector may be inserted into the socket. A sealed chamber between the socket and the male-type connector may be filled with fluid and the hydraulic effect of the fluid in the sealed chamber may result in a coupling of downhole tool 158 and component 164. During the wireline operation, the forces acting on downhole tool 158 during the wireline operation (e.g., gravity) may pull the downhole tool in the downhole direction. The differential pressure of the fluid in the chamber between the socket and the male-type connector may keep the socket and male-type connector coupled during the failure.

Figure 2:
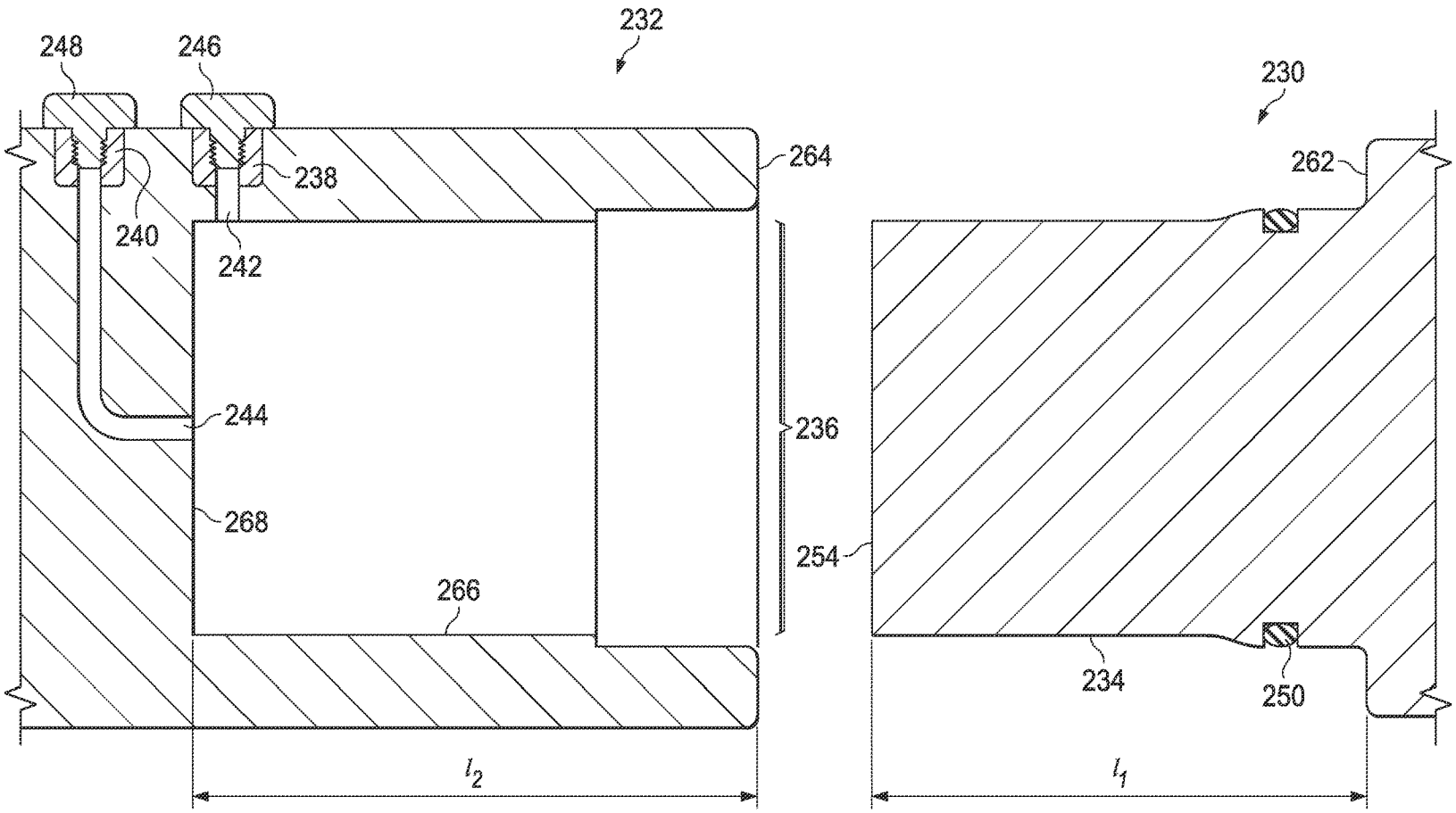
FIG. 2 illustrates a cross-sectional view of a downhole tool and a drill string component.

FIG. 2 illustrates a cross-sectional view of a downhole tool and a drill string component. Downhole tool 230 may be any suitable downhole tool, such as a drill bit, a coring bit, a drill collar, a rotary steering tool, a directional drilling tool, a downhole drilling motor, a reamer, a hole enlarger, or a stabilizer. Downhole tool 230 may include connector 234, which may be a male-type connector. Connector 234 may have any suitable cross-sectional shape, such as a polygon, a triangle, a square, a rectangle, a spline, or an oval. The shape of connector 234 may be based on the requirements of the subterranean operation (e.g., the expected torque created during the subterranean operation). For example, connector 234 having a polygon shape may be able to withstand a higher amount of torque produced by downhole tool 230 than connector 234 having a square shape.

Drill string component 232 may be a section of the drill string (e.g., drill string 103 shown in FIG. 1) or a component attached to the drill string (e.g., components 122*a*, 122*b*, and/or 122*c*) to which downhole tool 230 may be coupled. Drill string component 232 may be located uphole from downhole tool 230. In some embodiments, multiple downhole tools may be connected in series and drill string component 232 may be a portion of another downhole tool 230 located uphole from downhole tool 230. Drill string component 232 may be coupled to the drill string through any suitable coupling mechanism, such as threading, polygon, spline coupling, and/or interlocking mechanisms. Drill string component 232 may include socket 236, which may be a female-type connector for receiving connector 234 of downhole tool 230. Socket 236 may have a shape corresponding to the shape of connector 234. For example, in embodiments where connector 234 has a polygon shape, socket 236 may also have a polygon shape such that connector 234 fits securely in socket 236 and connector 234 does not move relative to socket 236 during the subterranean operation.

Connector 234 may be inserted into socket 236 until shoulder 262 on downhole tool 230 is in contact with surface 264 of drill string component 232. When shoulder 262 and surface 264 are in contact, connector 234 may be considered fully inserted into socket 236. The length of connector 234, shown as $l_1$ in FIG. 2, may be shorter than the length of socket 236, shown as $l_2$ in FIG. 2 so that when connector 234 is inserted into socket 236, a chamber (e.g., chamber 352 shown in FIG. 3) is created between top surface 254 of connector 234 and top surface 268 of socket 236. The chamber may be filled with a fluid, as described in further detail with respect to FIG. 3. The difference between the length of socket 236 and the length of connector 234 may determine the size of the chamber. The size of the chamber may be based on the requirements of the subterranean operation. For example, if the temperature in the wellbore is expected to be high, the fluid in the chamber may expand. The expansion of the fluid may exert an axial load on drill string component 232 and/or downhole tool 230. The size of the chamber may be small to reduce the volume of fluid in the chamber and the amount the fluid can expand due to the increased temperature, thus reducing the axial load caused by the expansion.

Drill string component 232 may additionally include funnels 238 and 240 in fluidic communication with channels 242 and 244. Funnels 238 and 240 may be used to fill channels 242 and 244 with fluid when drill string component 232 and downhole tool 230 are coupled together, as described in further detail with respect to FIG. 3. Funnels 238 and 240 may be closed with caps 246 and 248 to prevent fluid from leaking from channels 242 and 244. Funnels 238 and 240 may be any suitable size such that a fluid, such as oil or hydraulic fluid, may be communicated through funnels 238 and 240 into channels 242 and 244. The size of funnels 238 and 240 may be based on the size of drill string component 232 and/or the amount of oil placed in channels 242 and 244 and the chamber between drill string component 232 and downhole tool 230 (e.g., chamber 352 shown in FIG. 3). For example, the size of funnels 238 and 240 may be larger if the size of the chamber is larger such that the larger amount of fluid may be funneled through funnels 238 and 240 and into channels 242 and 244 in a relatively short amount of time to avoid delays during the subterranean operation. In some embodiments funnels 238 and 240 may be the same size while in other embodiments funnel 238 may be a different size than funnel 240.

Channels 242 and 244 may be any suitable shape and size to allow fluid to be added to channels 242 and 244 and fill a chamber between downhole tool 230 and drill string component 232. For example, channel 242 and/or channel 244 may have a round, oval, square or any suitable cross-sectional shape. While channels 242 and 244 are shown in FIG. 2 as taking a relatively direct path from top surface 268 and wall 266 of socket 236, channels 242 and 244 may take any path from the chamber to the exterior of drill string component 232. While both channels 242 and 244 are shown in FIG. 2 as being channels in drill string component 232, one or both of channels 242 and 244 may be channels in downhole tool 230.

Caps 246 and 248 may seal funnels 238 and 240, respectively, such that the fluid located in channels 242 and 244 remains in channels 242 and 244 and does not leak out of channels 242 and 244 through funnels 238 and 240. Cap 246 and/or cap 248 may couple to funnel 238 and/or funnel 240 through any suitable coupling mechanism, such as threading or an interference fit. Caps 246 and 248 may include a sealing element, such as an O-ring, that seals any gaps between funnel 238 and cap 246 and/or between funnel 240 and cap 248. In some embodiments, cap 246 and/or cap 248 may be a plug that may be held in place via a retaining ring. The plug may be formed of an elastomeric material, such as rubber or any other suitable pliable material, and may create a seal between the plug and funnel 238 and/or 240 without the need for a separate sealing element.

One or more O-rings 250 may be included on either the outer perimeter of connector 234 of downhole tool 230 and/or wall 266 of socket 236. For example, in FIG. 2, O-ring 250 is shown as being coupled to connector 234. O-ring 250 may create a seal between the outer perimeter of connector 234 and wall 266 of socket 236 to prevent the fluid from leaking from the chamber between downhole tool 230 and drill string component 232. Additionally, O-ring 250 may seal the chamber to maintain the pressure of the fluid in the chamber during the subterranean operation.

Figure 3:
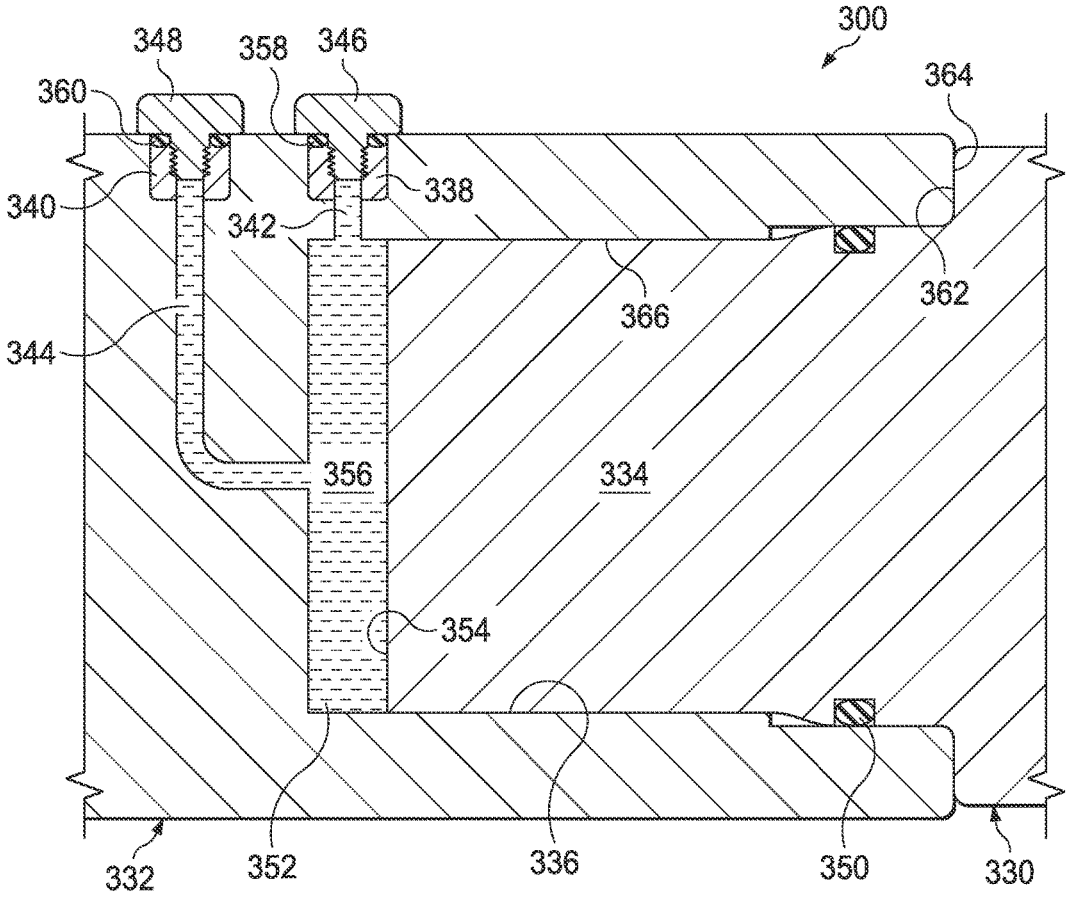
FIG. 3 illustrates a cross-sectional view of a downhole tool and a drill string component coupled via an axial retention connection.

During a subterranean operation, downhole tool 230 may be coupled to drill string component 232. FIG. 3 illustrates a cross-sectional view of a downhole tool and a drill string component coupled via an axial retention connection. Downhole tool 330 may be coupled to drill string component 332 prior to placing downhole tool 330 and drill string component 332 in a wellbore (e.g., wellbore 103 in FIG. 1). Downhole tool 330 may be similar to downhole tool 230, shown in FIG. 2, and may be any suitable downhole tool including a drill bit, a coring bit, a drill collar, a rotary steering tool, a directional drilling tool, a downhole drilling motor, a reamer, a hole enlarger, or a stabilizer. Drill string component 332 may be similar to drill string component 232 shown in FIG. 2 and may be a component attached to a drill string. Drill string component 332 may be coupled to the drill string through any suitable coupling mechanism, such as such as threading, polygon, spline coupling, and/or interlocking mechanisms. In embodiments where multiple downhole tools 332 are connected in series, drill string component 332 may be a section of another downhole tool 330 to which downhole tool 330 is to be attached.

Connector 334 on downhole tool 330 may be inserted into socket 336 of drill string component 332. Connector 334 may be a male-type connector and socket 336 may be a female-type connector. Connector 334 may have any suitable cross-section, such as a polygon, a square, or a rectangle, and socket 336 may have a compatible shape such that connector 334 may fit securely in socket 336 without allowing connector 334 to move or rotate relative to socket 336.

Prior to inserting connector 334 into socket 336, cap 346 and/or cap 348 may be removed from funnel 338 and/or funnel 340, respectively. The removal of cap 346 and/or cap 348 may allow air to escape from the space between connector 334 and socket 336 when connector 334 is inserted into socket 336.

When inserting connector 334 into socket 336, connector 334 may initially be partially inserted into socket 336. For example, connector 334 may be inserted halfway into socket 336 or any other suitable distance such that O-ring 350 creates a fluid-tight seal between downhole tool 330 and drill string component 332 but shoulder 362 is not in contact with surface 364. Once downhole tool 330 is inserted into drill string component 332, chamber 352 may be created in socket 336 between top surface 354 of connector 334 and wall 366 of socket 336.

Once chamber 352 is created, chamber 352 may be filled with fluid 356. Fluid 356 may be any suitable incompressible fluid, such as hydraulic fluid or oil. Fluid 356 may be added to chamber 352 through funnel 338 and/or funnel 340 and may flow through channel 342 and/or channel 344 into chamber 352. For example, in embodiments where fluid 356 is added to chamber 352 through funnel 338, fluid 356 may flow through channel 342 and into chamber 352. The fluid located in channels 342 and 344 and chamber 352 may be in fluid communication such that the pressure of the fluid in channels 342 and 344 and chamber 352 is the same.

Fluid 356 may be added to chamber 352 until fluid 356 exits (e.g., spills over) funnel 338 and/or funnel 340. The presence of fluid 356 exiting funnels 338 and/or funnel 340 may indicate that chamber 352 is full. After chamber 352 has been filled with fluid 356, cap 346 may be placed in funnel 338 and may seal funnel 338 to prevent fluid 356 from exiting chamber 352 or channel 342 through funnel 338. Cap 346 may be coupled to funnel 338 via any suitable coupling mechanism such as threading or an interference fit. Cap 346 may include sealing element 358. Sealing element 358 may be any suitable sealing device, such as an O-ring, that may provide a greater seal than cap 346 alone and seal any gaps between funnel 338 and cap 346. In some embodiments, cap 346 may be a plug that may be held in place with a retaining ring. The plug may be formed of an elastomeric material such as rubber or any other suitable pliable material, and may create a seal between the plug and funnel 338 and may not use a separate sealing element 358.

Once cap 346 is securely placed in funnel 338, connector 334 may be further inserted into socket 336 until connector 334 is fully inserted into socket 336. Connector 334 may be fully inserted in socket 336 when shoulder 362 is in contact with bottom surface 364 of drill string component 332. As connector 334 is further inserted in socket 336, fluid 356 may exit channel 344 and/or chamber 352 through funnel 340. The movement of connector 334 into socket 336 may remove any air pockets remaining in chamber 352 and ensure that chamber 352 is filled completely with fluid 356.

Downhole tool 330 and/or drill string component 332 may include one or more O-rings 350 that create a seal between the outer perimeter of connector 334 and wall 366 of socket 336 to prevent the fluid from leaking out of chamber 352. Additionally, O-ring 350 may seal chamber 352 to maintain the pressure of fluid 356 in chamber 352 during a subterranean operation.

Once connector 334 is fully inserted in socket 336, cap 348 may be inserted in funnel 340 to seal funnel 340 and prevent fluid 356 from exiting funnel 340. Cap 348 may be coupled to funnel 340 via any suitable coupling mechanism such as threading or an interference fit. Cap 348 may include sealing element 360. Sealing element 360 may be any suitable sealing device, such as an O-ring, that provides a greater seal than cap 348 alone and seal any gaps between funnel 340 and cap 348. In some embodiments, cap 348 may be a plug that may be held in place via a retaining ring. The plug may be formed of rubber and may create a seal between the plug and funnel 340 and may not use a separate sealing element 360. In some embodiments, cap 346 and cap 348 may be the same type of cap and may have the same type of sealing elements 358 and 360. In other embodiments, cap 346 and cap 348 may be different types of caps and/or use different types of sealing elements 358 and 360. For example, cap 346 may be threaded cap with an O-ring and cap 348 may be a rubber plug.

When connector 334 is fully inserted in socket 336 and caps 346 and 348 are placed in funnels 338 and 340, chamber 352 may be sealed such that fluid 356 may be prevented from exiting chamber 352. When downhole tool 330 and drill string component 332 are lowered in the wellbore, the temperature of fluid 356 may increase due to the increased temperature in the wellbore. The temperature increase of fluid 356 may cause the volume of fluid 356 to increase based on the volumetric expansion coefficient of fluid 356. Because chamber 352 is sealed, the expansion of fluid 356 may create a force on connector 334 and cause connector 334 to move in the axial direction. The volume of chamber 352 may be based on the amount of axial movement determined to be within the tolerances of the subterranean operation. However, the axial movement of connector 334 (and thus downhole tool 330) may not be large enough to cause connector 334 to move by a distance such that O-ring 350 is no longer in contact with wall 366 of socket 336 and thus no longer sealing chamber 352.

Similarly, the increased temperature in the wellbore may cause the components of drilling tool 330 and/or drill string component 332 to expand based on the volumetric expansion coefficient of the material of which drilling tool 330 and/or drill string component 332 is made. Drilling tool 330 and/or drill string component 332 may be made of a material with a small volumetric expansion coefficient (e.g., stainless steel) such that the axial movement caused by the expansion of drilling tool 330 and/or drill string component 332 is a small deflection when compared to the length of connector 334 and/or socket 336 such that O-ring 350 remains in contact with wall 366.

Fluid 356 in chamber 352 may create a hydraulic effect that creates a coupling between downhole tool 330 and drill string component 332 such that a large amount of force may be required to separate downhole tool 330 and drill string component 332. The forces acting on downhole tool 330 during the subterranean operation (e.g., WOB) may push downhole tool 330 uphole and into drill string component. Thus the forces created during the subterranean operation maintain the coupling of downhole tool 330 and drill string component 332.

During subterranean operations, failures may occur in the wellbore. For example, the drill bit or the components on the drill bit may erode, wear, or break or a connection between two downhole tools may break. During a failure, the forces pushing downhole tool 330 uphole into drill string component 332 may be reduced or eliminated. The weight of downhole tool 330 (and any other downhole tools connected to downhole tool 330) may exert force on downhole tool 330 in a direction away from drill string component 332 (e.g., in the downhole direction). The hydraulic effect of fluid 356 sealed in chamber 352 may keep downhole tool 330 coupled to drill string component 332 such that the weight of downhole tool 330 may be insufficient to overcome the hydraulic effect and separate downhole tool 330 from drill string component 332.

When the subterranean operation is complete and downhole tool 330 has returned to the well surface, downhole tool 330 and drill string component 332 may be separated by removing one or both caps 346 and/or 348 and releasing the pressure of fluid 356. When the pressure of fluid 356 is released, downhole tool 330 and drill string component 332 may be separated by sliding connector 334 out of socket 336.

During a wireline operation, an axial retention connection may be used to couple a wireline component to a downhole tool or couple two downhole tools. FIG. 4 illustrates a cross-sectional view of a downhole tool and wireline component coupled via an axial retention connection. Downhole tool 430 may be coupled to wireline component 432 prior to placing downhole tool 430 and wireline component 432 in a wellbore (e.g., wellbore 154 in FIG. 1B). Downhole tool 430 may be similar to downhole tool 230, shown in FIG. 2, and may be any suitable downhole tool. Examples of downhole wireline tools may include, but are not limited to, acoustic, neutron, gamma ray, density, photoelectric, nuclear magnetic resonance, induction, resistivity, caliper, coring, seismic, rotary steering, and/or any other commercially available well tools. Wireline component 432 may be similar to drill string component 232 shown in FIG. 2 and may be a component attached to a line suspended in a wellbore. Wireline component 432 may be coupled to the line through any suitable coupling mechanism, such as such as threading, polygon, spline coupling, and/or interlocking mechanisms. In embodiments where multiple downhole tools 432 are connected in series, wireline component 432 may be a section of another downhole tool 430 to which downhole tool 430 is to be attached.

Connector 434 on downhole tool 430 may be inserted into socket 436 of wireline component 432. Connector 434 may be a male-type connector and socket 436 may be a female-type connector. Connector 434 may have any suitable cross-section, such as a polygon, a square, or a rectangle, and socket 436 may have a compatible shape such that connector 434 may fit securely in socket 436 without allowing connector 434 to move or rotate relative to socket 436.

Prior to inserting connector 434 into socket 436, cap 446 and/or cap 448 may be removed from funnel 438 and/or funnel 440, respectively. The removal of cap 446 and/or cap 448 may allow air to escape from the space between connector 434 and socket 436 when connector 434 is inserted into socket 436.

When inserting connector 434 into socket 436, connector 434 may initially be partially inserted into socket 436. For example, connector 434 may be inserted halfway into socket 436 or any other suitable distance such that O-ring 450 creates a fluid-tight seal between downhole tool 430 and wireline component 432 but shoulder 462 is not in contact with surface 464. Once downhole tool 430 is inserted into wireline component 432, chamber 452 may be created in socket 436 between top surface 454 of connector 434 and wall 466 of socket 436.

Once chamber 452 is created, chamber 452 may be filled with fluid 456. Fluid 456 may be any suitable incompressible fluid, such as hydraulic fluid or oil. Fluid 456 may be added to chamber 452 through funnel 438 and/or funnel 440 and may flow through channel 442 and/or channel 444 into chamber 452. For example, in embodiments where fluid 456 is added to chamber 452 through funnel 438, fluid 456 may flow through channel 442 and into chamber 452. The fluid located in channels 442 and 444 and chamber 452 may be in fluid communication such that the pressure of the fluid in channels 442 and 444 and chamber 452 is the same.

Fluid 456 may be added to chamber 452 until fluid 456 exits (e.g., spills over) funnel 438 and/or funnel 440. The presence of fluid 456 exiting funnels 438 and/or funnel 440 may indicate that chamber 452 is full. After chamber 452 has been filled with fluid 456, cap 446 may be placed in funnel 438 and may seal funnel 438 to prevent fluid 456 from exiting chamber 452 or channel 442 through funnel 438. Cap 446 may be coupled to funnel 438 via any suitable coupling mechanism such as threading or an interference fit. Cap 446 may include sealing element 458. Sealing element 458 may be any suitable sealing device, such as an O-ring, that may provide a greater seal than cap 446 alone and seal any gaps between funnel 438 and cap 446. In some embodiments, cap 446 may be a plug that may be held in place with a retaining ring. The plug may be formed of an elastomeric material such as rubber or any other suitable pliable material, and may create a seal between the plug and funnel 438 and may not use a separate sealing element 458.

Once cap 446 is securely placed in funnel 438, connector 434 may be further inserted into socket 436 until connector 434 is fully inserted into socket 436. Connector 434 may be fully inserted in socket 436 when shoulder 462 is in contact with bottom surface 464 of wireline component 432. As connector 434 is further inserted in socket 436, fluid 456 may exit channel 444 and/or chamber 452 through funnel 440. The movement of connector 434 into socket 436 may remove any air pockets remaining in chamber 452 and ensure that chamber 452 is filled completely with fluid 456.

Downhole tool 430 and/or wireline component 432 may include one or more O-rings 450 that create a seal between the outer perimeter of connector 434 and wall 466 of socket 436 to prevent the fluid from leaking out of chamber 452. Additionally, O-ring 450 may seal chamber 452 to maintain the pressure of fluid 456 in chamber 452 during a subterranean operation.

Once connector 434 is fully inserted in socket 436, cap 448 may be inserted in funnel 440 to seal funnel 440 and prevent fluid 456 from exiting funnel 440. Cap 448 may be coupled to funnel 440 via any suitable coupling mechanism such as threading or an interference fit. Cap 448 may include sealing element 460. Sealing element 460 may be any suitable sealing device, such as an O-ring, that provides a greater seal than cap 448 alone and seal any gaps between funnel 440 and cap 448. In some embodiments, cap 448 may be a plug that may be held in place via a retaining ring. The plug may be formed of rubber and may create a seal between the plug and funnel 440 and may not use a separate sealing element 460. In some embodiments, cap 446 and cap 448 may be the same type of cap and may have the same type of sealing elements 458 and 460. In other embodiments, cap 446 and cap 448 may be different types of caps and/or use different types of sealing elements 458 and 460. For example, cap 446 may be threaded cap with an O-ring and cap 448 may be a rubber plug.

In some embodiments, wireline component 432 and/or downhole tool 430 may have channel 468 passing through wireline component 432 and/or downhole tool 430. Channel 468 may house line 470 which may transmit data, power, and/or signals to downhole hole tool 430. Wireline component 432 may include O-ring 472 located uphole from chamber 452 to seal chamber 452 and prevent fluid 456 from exiting chamber 452 through an uphole portion of channel 468. Downhole tool 430 may include O-ring 474 located downhole from chamber 452 to seal chamber 452 and prevent fluid 456 from exiting chamber 452 through a downhole portion of channel 468. While the embodiment shown in FIG. 4 illustrates a wireline system, in other embodiments channel 468 may house a drive shaft which may rotate downhole tool 430.

When connector 434 is fully inserted in socket 436 and caps 446 and 448 are placed in funnels 438 and 440, chamber 452 may be sealed such that fluid 456 may be prevented from exiting chamber 452. When downhole tool 430 and wireline component 432 are lowered in the wellbore, the temperature of fluid 456 may increase due to the increased temperature in the wellbore. The temperature increase of fluid 456 may cause the volume of fluid 456 to increase based on the volumetric expansion coefficient of fluid 456. Because chamber 452 is sealed, the expansion of fluid 456 may create a force on connector 434 and cause connector 434 to move in the axial direction. The volume of chamber 452 may be based on the amount of axial movement determined to be within the tolerances of the subterranean operation. However, the axial movement of connector 434 (and thus downhole tool 430) may not be large enough to cause connector 434 to move by a distance such that O-ring 450 is no longer in contact with wall 466 of socket 436 and thus no longer sealing chamber 452.

Similarly, the increased temperature in the wellbore may cause the components of drilling tool 430 and/or wireline component 432 to expand based on the volumetric expansion coefficient of the material of which drilling tool 430 and/or wireline component 432 is made. Drilling tool 430 and/or wireline component 432 may be made of a material with a small volumetric expansion coefficient (e.g., stainless steel) such that the axial movement caused by the expansion of drilling tool 430 and/or wireline component 432 is a small deflection when compared to the length of connector 434 and/or socket 436 such that O-ring 450 remains in contact with wall 466.

Fluid 456 in chamber 452 may create a hydraulic effect that creates a coupling between downhole tool 430 and wireline component 432 such that a large amount of force may be required to separate downhole tool 430 and wireline component 432. During wireline operations, the weight of downhole tool 430 (and any other downhole tools connected to downhole tool 430) may exert force on downhole tool 430 in a direction away from wireline component 432 (e.g., in the downhole direction). The hydraulic effect of fluid 456 sealed in chamber 452 may keep downhole tool 430 coupled to wireline component 432 such that the weight of downhole tool 430 may be insufficient to overcome the hydraulic effect and separate downhole tool 430 from wireline component 432.

When the subterranean operation is complete and downhole tool 430 has returned to the well surface, downhole tool 430 and wireline component 432 may be separated by removing one or both caps 446 and/or 448 and releasing the pressure of fluid 456. When the pressure of fluid 456 is released, downhole tool 430 and wireline component 432 may be separated by sliding connector 434 out of socket 436.

Embodiments disclosed herein include:

A. An axial retention connection including a drill string component including a socket having a plurality of walls and a top surface, a downhole tool coupled to the socket, the downhole tool including a male-type connector having an outer perimeter and a top surface, a seal between the drill string component and the downhole tool, a chamber formed by the plurality of walls and the top surface of the socket and the top surface of the male-type connector, and a fluid filling the chamber.

B. A drilling system including a drill string, a drill string component coupled to the drill string including a socket having a wall and a top surface, a downhole tool coupled to the socket to create a chamber, the downhole tool including a male-type connector having a wall and a top surface, a seal between the drill string component and the downhole tool, a chamber formed by the wall and the top surface of the socket and the top surface of the male-type connector, and a fluid filling the chamber.

C. A method for coupling a downhole tool including partially inserting a downhole tool into a socket on a drill string component, filling a chamber between the downhole tool and the drill string component with a fluid through at least one of a first funnel and a second funnel, the first funnel coupled to a first pathway and the second funnel coupled to a second pathway, the first and second pathways fluidically coupling the first and second funnels and the chamber, placing a first cap over the first funnel, fully inserting the downhole tool into the socket, and placing a second cap over the second funnel.

Each of embodiments A, B, and C may have one or more of the following additional elements in any combination: Element 1: further comprising the drill string component further including a first pathway extending from a first exterior side of the drill string component to a wall of the socket and including a first funnel, and a second pathway extending from a second exterior side of the drill string component to a top of the socket and including a second funnel; a first cap configured to seal a first funnel, a second cap configured to seal a second funnel, and the fluid further filling the first pathway and the second pathway. Element 2: wherein at least one of the first cap and the second cap further include a seal. Element 3: wherein the first exterior side and the second exterior side are on the same side of the drill string component. Element 4: wherein the male-type connector and the socket have a compatible shape and are configured to prevent rotation of the male-type connector relative to the socket. Element 5: wherein the compatible shape is a polygon. Element 6: wherein the seal is an O-ring. Element 7: wherein the fluid is a hydraulic fluid. Element 8: wherein the size of the chamber is based on an expected axial expansion of the fluid during a subterranean operation. Element 9: wherein the fluid is selected based on a volumetric expansion coefficient of the fluid. Element 10: further comprising a channel passing through the drill string component and the downhole tool, a second seal located along the channel uphole of the chamber, and a third seal located along the channel downhole of the chamber.

Although the present disclosure and its advantages have been described in detail, it should be understood that various changes, substitutions and alterations can be made herein without departing from the spirit and scope of the disclosure as defined by the following claims.

What is claimed is:

1. An axial retention connection, comprising:

a drill string component including a socket having a plurality of walls and a top surface;

a downhole tool coupled to the socket, the downhole tool including a male-type connector having an outer perimeter and a top surface;

a seal between the drill string component and the downhole tool;

a chamber formed by the plurality of walls and the top surface of the socket and the top surface of the male-type connector; and a non-compressible fluid filling the chamber such that the hydraulic effect of the non-compressible fluid in the chamber couples the drill string component and the downhole tool and limits axial movement between the drill string component and the downhole tool to less than a length of the male-type connector.

2. The axial retention connection of claim 1, further comprising:

the drill string component further including a first pathway extending from a first exterior side of the drill string component to a wall of the socket and including a first funnel; and a second pathway extending from a second exterior side of the drill string component to a top of the socket and including a second funnel;

a first cap configured to seal a first funnel;

a second cap configured to seal a second funnel; and the fluid further filling the first pathway and the second pathway.

3. The axial retention connection of claim 2, wherein at least one of the first cap and the second cap further include a seal.

4. The axial retention connection of claim 2, wherein the first exterior side and the second exterior side are on the same side of the drill string component.

5. The axial retention connection of claim 1, wherein the male-type connector and the socket have a compatible shape and are configured to prevent rotation of the male-type connector relative to the socket.

6. The axial retention connection of claim 5, wherein the compatible shape is a polygon.

7. The axial retention connection of claim 1, wherein the seal is an O-ring.

8. The axial retention connection of claim 1, wherein the fluid is a hydraulic fluid.

9. The axial retention connection of claim 1, wherein the size of the chamber is based on an expected axial expansion of the fluid during a subterranean operation.

10. The axial retention connection of claim 1, wherein the fluid is selected based on a volumetric expansion coefficient of the fluid.

11. The axial retention connection of claim 1, further comprising:

a channel passing through the drill string component and the downhole tool;

a second seal located along the channel uphole of the chamber; and a third seal located along the channel downhole of the chamber.

12. A drilling system, comprising:

a drill string;

a drill string component coupled to the drill string including a socket having a wall and a top surface;

a downhole tool coupled to the socket to create a chamber, the downhole tool including a male-type connector having a wall and a top surface;

a seal between the drill string component and the downhole tool;

the chamber formed by the wall and the top surface of the socket and the top surface of the male-type connector; and a non-compressible fluid filling the chamber such that the hydraulic effect of the non-compressible fluid in the chamber couples the drill string component and the downhole tool and limits axial movement between the drill string component and the downhole tool to less than a length of the male-type connector.

13. The drilling system of claim 12, further comprising:

the drill string component further including a first pathway extending from a first exterior side of the drill string component to a wall of the socket and including a first funnel; and a second pathway extending from a second exterior side of the drill string component to a top of the socket and including a second funnel;

a first cap configured to seal a first funnel;

a second cap configured to seal a second funnel; and the fluid further filling the first pathway and the second pathway.

14. The drilling system of claim 13, wherein at least one of the first cap and the second cap further include a seal.

15. The drilling system of claim 12, wherein the male-type connector and the socket have a compatible shape and are configured to prevent rotation of the male-type connector relative to the socket.

16. The drilling system of claim 12, wherein the fluid is a hydraulic fluid.

17. The drilling system of claim 12, wherein the size of the chamber is based on an expected axial expansion of the fluid during a subterranean operation.

18. A method for coupling a downhole tool, comprising:

partially inserting a downhole tool into a socket on a drill string component;

filling a chamber between the downhole tool and the drill string component with a non-compressible fluid through at least one of a first funnel and a second funnel, the hydraulic effect of the non-compressible fluid in the chamber coupling the drill string component and the downhole tool and limiting axial movement between the drill string component and the downhole tool to less than a length of a male-type connector on the downhole tool, the first funnel coupled to a first pathway and the second funnel coupled to a second pathway, the first and second pathways fluidically coupling the first and second funnels and the chamber;

placing a first cap over the first funnel;

fully inserting the downhole tool into the socket; and placing a second cap over the second funnel.

19. The method of claim 18, wherein the fluid is a hydraulic fluid.

20. The method of claim 18, wherein the size of the chamber is based on an expected axial expansion of the fluid during a subterranean operation.

* * * * *